US008324807B2

(12) United States Patent
Wang et al.

(10) Patent No.: US 8,324,807 B2
(45) Date of Patent: Dec. 4, 2012

(54) PHOTOMULTIPLIER TUBE FOR COLLECTING PHOTOELECTRONS FROM A PHOTOCATHODE COVERING A WHOLE INNER SURFACE OF A VACUUM CONTAINER

(75) Inventors: Yi fang Wang, Beijing (CN); Sen Qian, Beijing (CN); Tian chi Zhao, Seattle, WA (US); Jun Cao, Beijing (CN)

(73) Assignee: Institute of High Energy Physics, Chinese Academy of Sciences, Beijing (CN)

( * ) Notice: Subject to any disclaimer, the term of this patent is extended or adjusted under 35 U.S.C. 154(b) by 0 days.

(21) Appl. No.: 13/259,861

(22) PCT Filed: Jul. 20, 2009

(86) PCT No.: PCT/CN2009/000808

§ 371 (c)(1),
(2), (4) Date: Sep. 23, 2011

(87) PCT Pub. No.: WO2010/142064

PCT Pub. Date: Dec. 16, 2010

(65) Prior Publication Data

US 2012/0019132 A1 Jan. 26, 2012

(30) Foreign Application Priority Data

Jun. 10, 2009 (CN) ..... 2009 1 0147915

(51) Int. Cl.
*H01J 43/04* (2006.01)

(52) U.S. Cl. ..... 313/532; 313/533; 313/542; 313/544

(58) Field of Classification Search ..... 313/532, 313/533, 541, 542, 544, 103 R
See application file for complete search history.

(56) References Cited

U.S. PATENT DOCUMENTS

| | | | | |
|---|---|---|---|---|
| 4,564,753 | A | 1/1986 | Van Aller et al. | |
| 5,616,987 | A * | 4/1997 | Ohmura et al. | 313/533 |
| 5,736,731 | A * | 4/1998 | Kyushima et al. | 250/207 |
| 5,864,207 | A | 1/1999 | Kume et al. | |
| 5,883,466 | A * | 3/1999 | Suyama et al. | 313/542 |

(Continued)

FOREIGN PATENT DOCUMENTS

| | | |
|---|---|---|
| EP | 1 670 031 A1 | 6/2006 |
| GB | 499661 | 1/1939 |

OTHER PUBLICATIONS

International Search Report issued in International Patent Application No. PCT/CN2009/000808 dated Mar. 25, 2010.

(Continued)

*Primary Examiner* — Anh T. Mai
*Assistant Examiner* — Kevin Quarterman
(74) *Attorney, Agent, or Firm* — Oliff & Berridge, PLC

(57) ABSTRACT

A photomultiplier tube including a photocathode, an electron multiplier, an electron collector, and a power lead, wherein the photocathode and the electron multiplier are disposed in a sealed transparent vacuum envelope, the electron collector and the power lead are connected with an external circuit outside the vacuum envelope, the photocathode is formed on the entire inner surface of the vacuum envelope, and the electron multiplier is located on the internal center of the vacuum envelope to receive photoelectrons from the photocathode in all directions for electrons multiplication. Because the effective photocathode area is increased, the detection efficiency of unit light-receiving area is improved.

13 Claims, 3 Drawing Sheets

U.S. PATENT DOCUMENTS

| | | | | |
|---|---|---|---|---|
| 2002/0079838 | A1* | 6/2002 | Bach et al. | 313/533 |
| 2003/0127582 | A1* | 7/2003 | Jones | 250/207 |
| 2004/0129891 | A1* | 7/2004 | Takagi et al. | 250/397 |
| 2006/0055322 | A1* | 3/2006 | Sugiyama et al. | 313/542 |
| 2010/0102721 | A1* | 4/2010 | Fukasawa et al. | 313/544 |

OTHER PUBLICATIONS

Written Opinion issued in International Patent Application No. PCT/CN2009/000808 dated Mar. 25, 2010.

* cited by examiner

Prior Art

PHOTOMULTIPLIER TUBE FOR COLLECTING PHOTOELECTRONS FROM A PHOTOCATHODE COVERING A WHOLE INNER SURFACE OF A VACUUM CONTAINER

TECHNICAL FIELD

The present invention relates to a photo detection device and, in particular, to a photomultiplier tube based on the combination of a transmission mode photocathode and a reflection mode photocathode.

BACKGROUND

The photomultiplier tube is a kind of photo detector with excellent sensitivity and ultra-fast time response, which may be widely applied to equipments for photon counting, low-level -light detection, chemiluminescence, bioluminescence and the like. As a vacuum component, the conventional focusing type photomultiplier tube mainly comprises a photoemission cathode (also referred to photocathode), a focusing electrode, an electron multiplier and an electron collector (i.e. anode), wherein the photocathode is a very thin film made of a special photosensitive material deposited on a specific substrate, and may be classified into a transmission mode type and a reflection mode type according to the manner of photoelectric conversion.

Currently, the photocathodes of all the focusing type photomultiplier tubes are all transmission mode. The transmission mode photocathode is generally deposited on the inner surface of an input window at the top of the photomultiplier tube glass housing from which the light to be detected enters. As shown in FIG. 1, the operating process of this focusing type photomultiplier tube is as follows: when the incident photons pass through a front window of the transparent vacuum container 1 and impinge onto the photocathode 2, a portion of the photons are converted into photoelectrons, and the remaining photons penetrate the photocathode 2 and enter the vacuum container; a portion of the photoelectrons which have been converted from the photons in the photocathode 2 are absorbed by the photocathode 2, and the other portion of the photoelectrons (usually less than 30% of the total number of the incident photons) penetrate the photocathode 2, enter the vacuum container 1, are accelerated in the focusing electric field, and then enter a group of electron multipliers on the surfaces of which special materials are coated; the electrons which have been accelerated in the electric field impinge onto the surface of the electron multiplier electrode 3 to generate secondary electron emission. In this way, the multiplication of electron is achieved, and the multiplied secondary electron is collected by the anode 4 and then is output as a signal.

The above focusing type photomultiplier tube which adopts an electric field for focusing photoelectrons has a feature that the area of the photocathode is larger or much larger than that of the electron multiplier's surface for receiving photoelectrons, and such the feature is particularly suitable for fabricating a photomultiplier tube with a larger area. However, the conventional focusing type photomultiplier tube is often cylindrical or ellipsoidal; it is only possible to receive the light from the front by the transmission mode photocathode described above. In this case, the light is efficiently received within a space angle no more than $2\pi$ viewing angle, and the quantum efficiency for photoelectric conversion thus is low.

Furthermore, for the photomultiplier tube with a large area photocathode, the electron multiplier is generally the focusing dynode structure in FIG. 1, which is composed of a plurality of metal sheets provided with materials of high secondary electron emission coefficient on the surface. Such a focusing dynode structure is bulky, and is often located at the calabash-shaped rear opening at the lower part of the sealed vacuum container. For a large photomultiplier tube, this design results in some problems that there is substantial difference among the paths via which the photoelectrons emitted from the photocathode's surface arrive at the electron multiplier, and the distributions of the electric field which the photoelectrons experience are also different. As a result, the arrival time of the photoelectrons is also different, and it is difficult to obtain a satisfactory time response for a large photomultiplier tube.

It is necessary for the photomultiplier tube with a reflection mode photocathode to be provided with a substrate inside the transparent window of the vacuum container, and a reflection mode photocathode is deposited on the substrate. To cooperate with this reflection mode photocathode, it is required to apply an circular-cage type electron multiplier structure to implement the multiplication. Therefore, the effective area for receiving light of this photomultiplier tube is limited.

The photomultiplier tube also uses a microchannel plate as the electron multiplier. However, this kind of photomultiplier tubes using a microchannel plate are not focusing type, and the microchannel plate in the prior art is usually formed into the shape of a thin disk, so that it is impossible to achieve a relatively large area of the microchannel plate and it is required to place the microchannel plate adjacent to the photocathode. Since it is required that the area of the photocathode matches with that of the microchannel plate, the area of the photocathode is limited by the actually available microchannel plate.

SUMMARY OF THE INVENTION

An object of the present invention is to provide a photomultiplier tube with a large photocathode area, high photoquantum efficiency and simple structure.

The object of the present invention and the technical problem is solved by the following solutions, According to the present invention, a photomultiplier tube is proposed, which comprises: a photocathode for receiving light irradiation to generate photoelectrons; an electron multiplier for receiving photoelectrons emitted from the photocathode to generate multiplied electrons; an electron collector for collecting the multiplied electrons generated by the electron multiplier; and a power supply electrode for supplying the power to the photocathode and the electron multiplier;

wherein the photocathode and the electron multiplier are located within a transparent vacuum container, and the electron collector and the power supply electrode passing through the transparent vacuum container are connected to an external circuit; wherein the photocathode covers the whole inner surface of the transparent vacuum container; and wherein the electron multiplier is located at the internal center of the transparent vacuum container to receive photoelectrons from the photocathode in all directions and generate multiplied electrons.

If the incident light detected by the photomultiplier tube comes from all directions, the photocathode is coated on the whole inner surface of the transparent vacuum container at a uniform thickness.

If the incident light detected by the photomultiplier tube comes from a certain direction in front of the photomultiplier tube, the photocathode is coated on a half inner surface of the transparent vacuum container corresponding to the direction of the incident light at a first thickness, and is coated on the other half inner surface of the vacuum transparent container at a second thickness, wherein the first thickness is less than or equal to the second thickness.

To improve the quantum efficiency of the reflected portion, prior to coating the photocathode material on the other half inner spherical surface of the transparent vacuum container at a second thickness, a layer of highly reflection mode metal thin film is coated.

The electron multiplier, which is arranged to receive photoelectrons generated by the photocathode and generate multiplied electrons, has an area much smaller than that of the photocathode, and may be any one of microchannel plate, miniature dynode electrode, semiconductor diode, and avalanche silicon photoelectric detector. The electron multipliers are arranged at the internal center of the transparent vacuum container by means of two groups comprising an upper group and a lower group, two groups comprising a right group and a left group, or multiple groups in respective directions to establish a centro-symmetric focusing electric field between the photocathode and the electron multiplication electrode.

To efficiently collect the photoelectrons from the photocathode, the photomultiplier tube further comprises a focusing electrode surrounding the periphery of the electron multiplier.

Preferably, the transparent vacuum container may use a spherical, ellipsoidal, or cylindrical glass container.

Preferably, the electron multiplier comprises an anode and a cathode, wherein the cathode for each group of the microchannel plate is arranged to face the photocathode, and the anode for each group of the microchannel plate is arranged to face the electron collector.

Depending on the gain required, each group of the microchannel plate comprises a single sheet of microchannel plate or multiple sheets of microchannel plates which are connected in series.

Corresponding to each group of the electron multiplier, the electron collector may be a common collector for simultaneously receiving multiplied electrons generated by each group of the electron multiplier, or a plurality of electron collectors for respectively receiving multiplied electrons generated by each group of the electron multiplier.

The electron multiplier is arranged at the internal center of the transparent vacuum container by an insulating supporting rod.

EMBODIMENTS

Exemplary embodiments of the present invention will be described in details hereinafter. It should be noted that the embodiments described herein are intended to illustrate but not to limit the present invention.

Figure 1:
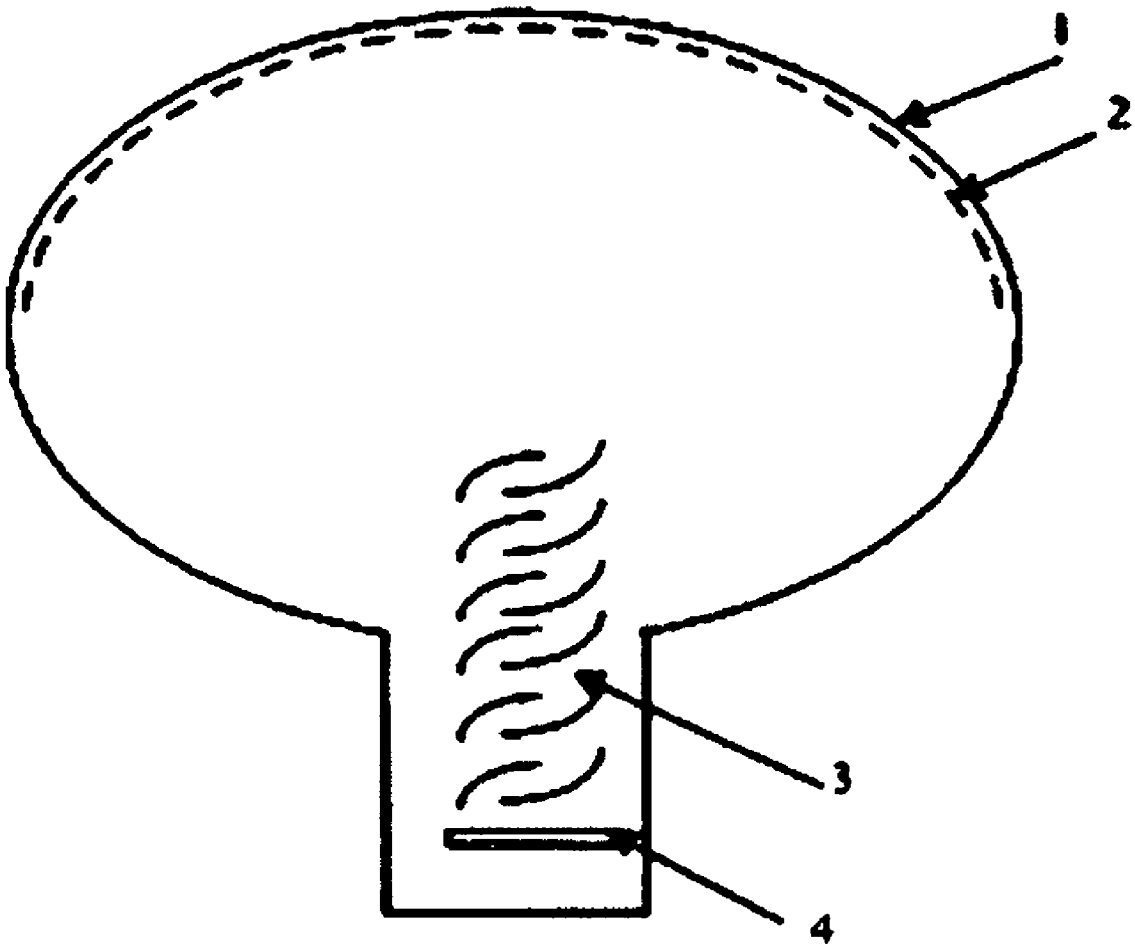
FIG. 1 is a structural schematic view showing a photomultiplier tube for a transmission mode photocathode in the prior art.
Figure 2:
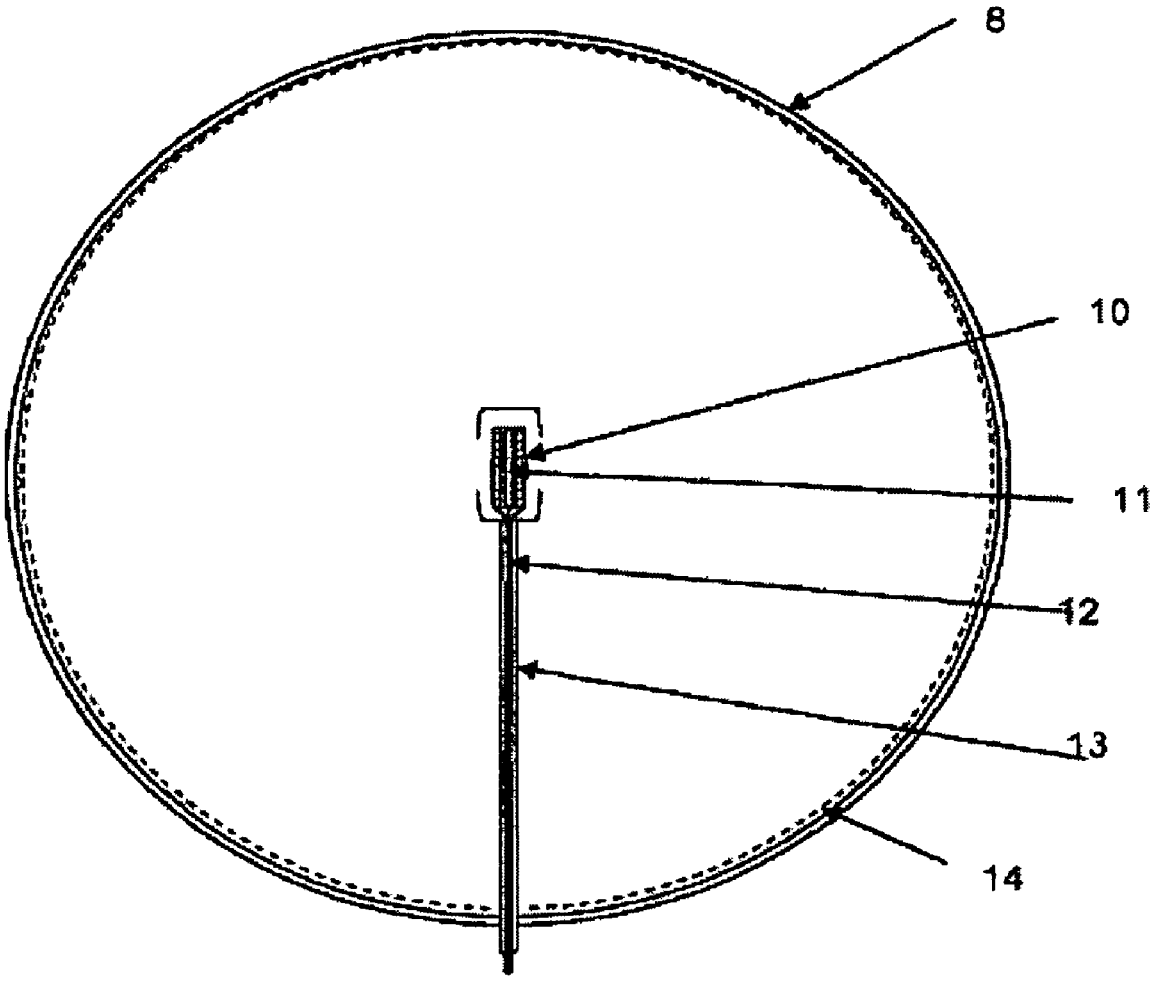
FIG. 2 is a structural schematic view showing an embodiment of the photomultiplier tube of the present invention.

FIG. 2 is a structural schematic view showing an embodiment of the photomultiplier tube of the present invention.

As shown in FIG. 2, the photomultiplier tube of the present invention mainly comprises a photocathode 14, an electron multiplier 10, an electron collector 11, and a power supply and signal lead 12. The above mentioned components of the photomultiplier tube of the present invention are all provided in a large transparent vacuum container 8. The transparent vacuum container 8 may be a spherical, approximately spherical and cylindrical glass vessel. Herein, reference is made to an approximately spherical transparent vacuum container to elucidate the present invention, and this is not intended to limit the protection scope of the present invention. The photocathode is deposited to cover the inner surface of the vacuum container 8. Except the slight surface of the vacuum container 8 for the power supply and signal lead, all the remaining inner surface of the vacuum container 8 is coated with material for the photocathode. Further, to receive all the incident photons from the photocathode, the electron multiplier 10 is arranged at the internal center of the vacuum container 8, receives photoelectrons from all directions, and generates multiplied electrons. Then the multiplied electrons are collected by the electron collector 11 and the amplified current signal is output by the electron collector 11. Herein, the power supply and signal lead 12 comprises a power supply line and a signal lead (indicated by one line in FIG. 2 for purpose of illustration). The power supply line functions as supplying power to the photocathode 14, the electron multiplier 10, and the electron collector 11 so as to induce potential difference there between in sequence. The signal lead may function as the signal line of the electron collector 11 for transferring the amplified current signal.

In the above design method in which the photocathode is deposited on almost all the inner surface of the vacuum container, when the incident photons is penetrating the wall of the vacuum container, a portion of the incident photons are converted into photoelectrons at the incident part of the photocathode, while the other portion of the incident photons, which penetrate the photocathode layer without reacting with the photocathode, obtain a second chance to generate photoelectric effect with the photocathode upon impinging onto the opposite vacuum container surface by utilizing the principle of reflection mode type photocathode and be converted into photoelectrons. As a result, the incident photons are maximally detected, so that the quantum efficiency by which the photomultiplier tube detects the photons may be substantially increased.

The above design method of photocathode is suitable for receiving incident light from all directions around the photomultiplier tube or that only from the front of the photomultiplier.

If the incident light comes from all directions, namely, incident photons exist all around the vacuum container, the photocathode made of suitable photocathode materials may be coated on the whole inner surface of the transparent vacuum container at a uniform thickness. The photocathode material may be bialkali or multialkali metals, and the thickness and structure during the coating process is determined according to the specific applications.

Figure 3:
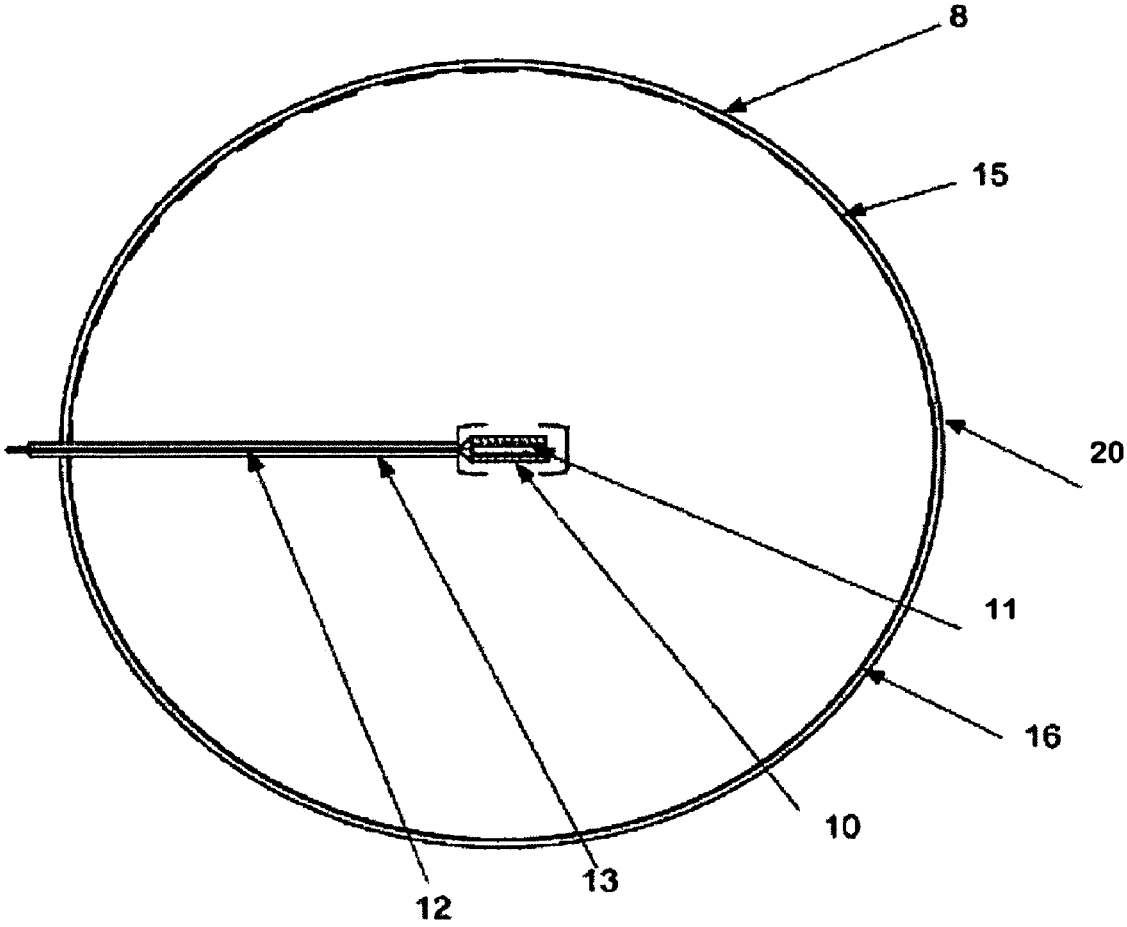
FIG. 3 is a structural schematic view showing another embodiment of the photomultiplier tube of the present invention.
Figure 4:
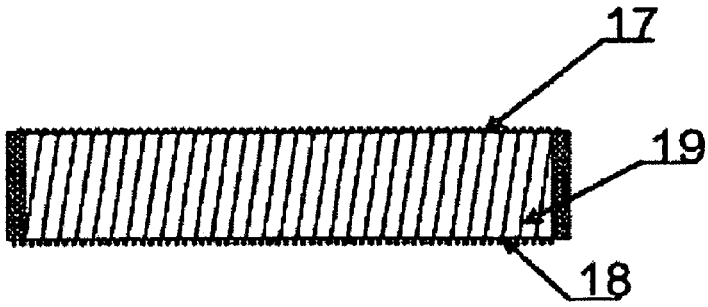
FIG. 4 is a structural schematic view showing a microchannel plate used in the photomultiplier tube of the present invention.

If the incident light only comes from the same direction, provided that from the front of the photomultiplier tube, a half inner surface of the vacuum container wall 8 facing the incident light is coated with a photocathode material of a predetermined thickness, the other half inner surface of the vacuum container 8 is coated with the photocathode material of another thickness. The thickness of the photocathode material coated on the other half inner surface is somewhat larger than that on the half inner surface facing the incident light. Reference is made to a spherical or nearly spherical vacuum container hereinafter. The front hemispherical surface of the spherical or nearly spherical vacuum container is coated with photocathode material of a predetermined thickness to form a transmission mode photocathode, and the rear hemispherical surface is coated with the photocathode material of another thickness to form a reflection mode photocathode. As shown in FIG. 3, the front hemispherical dotted portion 15 is a transmission mode photocathode, and the rear hemispherical solid portion 16 is a reflection mode photocathode. Furthermore, to further improve the light detection efficiency of the reflection mode photocathode, prior to coating the photocathode material on the rear hemispherical inner surface, a thin layer of highly reflection mode metal Al film 20 or other materials is coated, and then a reflection mode photocathode material ,which has a thickness equal to or larger than that of the transmission mode photocathode material deposited on the front hemispherical inner surface, is deposited on this metal film. Therefore, the total area covered by the transmission mode and reflection mode photocathodes approximates the whole surface of the vacuum container, so that it is enabled in this design method that, in case that the incident light only comes from the front of the photomultiplier tube or a certain angle, the quantum efficiency of the photoelectric conversion is higher than the value obtained by using the above-mentioned photocathode with an uniform thickness and the same structure but without the use of the metal reflection mode thin layer.

The electron multiplier in the above-mentioned photomultiplier tube may use a microchannel plate, a large area semiconductor diode, a large area semiconductor avalanche diode, or other electron multipliers with small size volume and thin thickness. The electron multipliers are appropriately at the center of the vacuum container. the electron multipliers may be arranged by means of two groups comprising an upper group and a lower group, two groups comprising a right group and a left group, or multiple groups in respective directions, wherein the multiple groups in respective directions, for example, may be located in a way that three or more groups of electron multipliers are tangentially arranged into a triangle surrounding the center of the vacuum container according to the design and the engineering requirements. As shown in FIGS. 2-3, the electron multipliers in FIG. 2 are arranged into a left group and a right group, while the electron multipliers in FIG. 3 are arranged into an upper group and a lower group, wherein in the above-mentioned two ways each group of the electron multiplier outputs the electron towards the electron collector. The potential of the electron multiplier is higher than that of the photocathode, so that the electron multiplier may efficiently receive all the photoelectrons emitted from the photocathode in all directions. In addition, the area of the electron multiplier is much smaller than that of the photocathode, so that an electric field distribution, which is approximately centro-symmetric and points from the spherical center to the spherical surface, is established between the photocathode and the electron multiplication electrode. The approximately centro-spherical symmetric electric field has relatively small interference, which helps to improve the consistency in term of the collection time of the photoelectrons. At the same time, a relatively small fraction of the photons which penetrate the photocathode to enter the vacuum container are blocked and absorbed by the electron multipliers or accessory parts thereof, which facilitates the improvement of the photoelectric conversion efficiency and photoelectron collection efficiency.

Preferably, by means of the focusing electrode 2 which is located at the periphery of the electron multiplier and is also connected with the power supply line, a focusing electric field is established between the photocathode and the focusing electrode, so that the photoelectrons emitted from the photocathode may be collected with a high efficiency close to 100%.

When a microchannel plate is used as the electron multiplier, the cathode 17 of each group of the microchannel plate is oriented toward the photocathode, and receives the photoelectrons emitted by the photocathode. The electrons are multiplied in the hollow glass fiber 19 of the microchannel plate and thereby the multiplied electrons are output to the electron collector 11 via the anode 18. Each group of the microchannel plate as electron multiplier described above may be microchannel plates which are connected in series in a single stage, two stages, or three stages way. A suitable voltage is applied between the cathode 17 and the anode 18 of the microchannel plate, so that a sufficient photoelectron amplification multiple may be obtained when the photomultiplier tube detects weak light or counts the measured single photon. The time response and noise characteristics of the microchannel plate—electron multiplier is superior to those of the dynode electrode combination which acts as the electron multiplier in the conventional focusing photomultiplier tube, so that the photomultiplier tube has a feature of fast time response and low noise.

The electron collector 11 may be a common collector which simultaneously receives electron current from each group of electron multiplier. The electron collector 11 may also be two or more electron collectors which receive electron current produced by two or more groups of electron multipliers, and then two or more output current are merged into one path. The electron collector may be made of copper plate or other metal materials, as the case for the conventional photomultiplier tube. In the present invention, if a microchannel plate is used as the electron multiplier, it is required that the area of the electron collector is larger than or equal to the anode area of the microchannel plate so as to collect the electron current from the microchannel plate in a better way.

When a semiconductor diode, avalanche diode, or other type of semiconductor electron multiplier is used, it is required that a high voltage is applied to these devices, so that the photoelectrons are accelerated to obtain enough kinetic energy to penetrate the protection layer on the surface of the semiconductor electron multiplier, and the sufficient multiplication factor is provided in the semiconductor electron multiplier. Due to the use of such a semiconductor electron multiplier, a relatively high voltage may be applied, which may further improve the time response of the photomultiplier tube.

The microchannel plate or the semiconductor electron multiplier tubes electrode, and the focusing electrode combined with it are supported by an insulating support 13 which usually is a glass tube. The power supply and signal lead 12 required for the electron multiplier may be arranged within the insulating support, and a welding process is implemented to attain vacuum sealing between the metal lead 12 and the glass support 13.

In this way, after an operating voltage is applied to the photocathode, the electron multiplier, and the electron collector, a focusing electric field is established between the photocathode and the electron multiplier, and a collection electric field is established between the electron multiplier and the electron collector. A portion of the light irradiation passes through the housing of the sealed container and directly enters into the transmission mode photocathode to generate photoelectrons, and the other portion is further reflected by the reflection mode photocathode to generate more photoelectrons after penetrating the transmission mode photocathode. All the electrons generated by the photocathode impinge onto the electron multiplier by acceleration in the focusing electric field, the electron current which has been multiplied by the electron multiplier enters into the electron collector by acceleration in the collection electric field, and thereby the collected current signal is output as a signal.

While the invention has been described in connection with typical embodiments, it will be understood that the terminology used herein is illustrative and exemplary, and is not intended as limiting. Since the present invention may be implemented in various forms without departing the concept and spirit of the present invention, the embodiments mentioned above are not limited to the details set forth herein, and should be contemplated broadly according to the concept and spirit defined by the claims. Therefore, the claims intend to cover all modifications and variations which fall within the following claims and equivalents thereto.

Industrial Applicability

According to the present invention, the photocathode covers the whole inner surface of the vacuum container, so that incident photons entering the vacuum container are converted into photoelectrons in the incident portion of the photocathode. On the other hand, the other portion of the photons which penetrate the photocathode layer without reacting with the photocathode, have a second chance to react with the photocathode and be converted into photoelectrons by utilizing the principle of reflection mode photocathode upon impinging onto the surface of the opposite vacuum container. As a result, the quantum efficiency of the photomultiplier tube is substantially increased, so that the area of the photocathode is efficiently used, and further the quantum conversion efficiency is improved.

What is claimed is:

1. A photomultiplier tube for collecting photoelectrons from a photocathode covering a whole inner surface of a vacuum container, comprising:

the photocathode for receiving light irradiation to generate the photoelectrons;

an electron multiplier for receiving the photoelectrons emitted from the photocathode to generate multiplied electrons;

an electron collector for collecting the multiplied electrons generated by the electron multiplier; and a power supply electrode for supplying power to the photocathode and the electron multiplier; wherein the photocathode and the electron multiplier are located within a transparent vacuum container, and the electron collector and the power supply electrode passing through the transparent vacuum container are connected to an external circuit, wherein, the photocathode covers the whole inner surface of the transparent vacuum container; and the electron multiplier is located at an internal center of the transparent vacuum container to receive the photoelectrons from the photocathode in all directions and generate the multiplied electrons.

2. The photomultiplier tube of claim 1, wherein, the photocathode is coated on a half inner surface of the transparent vacuum container at a first thickness, and is coated on an other half inner surface of the transparent vacuum container at a second thickness, wherein the first thickness is less than or equal to the second thickness.

3. The photomultiplier tube of claim 2, wherein, a layer of reflection mode metal thin film is further provided between the photocathode on the other half inner surface of the transparent vacuum container and a wall of the transparent vacuum container.

4. The photomultiplier tube of claim 1, wherein, the transparent vacuum container is a spherical, ellipsoidal, or cylindrical transparent vacuum container.

5. The photomultiplier tube of claim 1, wherein, the electron multiplier is a microchannel plate, a miniature dynode, a semiconductor diode, or an avalanche silicon photoelectric detector, and the electron multiplier is arranged at an internal center of the transparent vacuum container by means of a group of electron multipliers comprising an upper electron multiplier and a lower electron multiplier, a group of electron multipliers comprising a right electron multiplier and a left electron multiplier, or multiple groups of electron multipliers in respective directions.

6. The photomultiplier tube of claim 5, wherein, each group of the electron multipliers comprises a cathode and an anode, wherein the cathode for each group of the microchannel plate is arranged to face the photocathode, and the anode for each group of the electron multipliers is arranged to face the electron collector.

7. The photomultiplier tube of claim 5, wherein, each group of the electron multipliers is a single sheet of microchannel plate or multiple sheets of microchannel plates which are connected in series.

8. The photomultiplier tube of claim 5, wherein, the electron collector is a common collector for simultaneously receiving the multiplied electrons generated by each group of the electron multiplier, or a plurality of electron collectors for respectively receiving the multiplied electrons generated by each group of the electron multiplier.

9. The photomultiplier tube of claim 5, wherein, the electron multiplier is arranged at the internal center of the transparent vacuum container by an insulating supporting rod.

10. The photomultiplier tube of claim 1, wherein, the photomultiplier tube further comprises a focusing electrode surrounding a periphery of the electron multiplier.

11. The photomultiplier tube of claim 6, wherein, each group of the electron multipliers is a single sheet of microchannel plate or multiple sheets of microchannel plates which are connected in series.

12. The photomultiplier tube of claim 6, wherein, the electron collector is a common collector for simultaneously receiving the multiplied electrons generated by each group of the electron multiplier, or a plurality of electron collectors for respectively receiving the multiplied electrons generated by each group of the electron multiplier.

13. The photomultiplier tube of claim 6, wherein, the electron multiplier is arranged at the internal center of the transparent vacuum container by an insulating supporting rod.

* * * * *